US010277991B2

(12) United States Patent
Rosenkranz et al.

(10) Patent No.: US 10,277,991 B2
(45) Date of Patent: Apr. 30, 2019

(54) METHOD FOR OPERATING A BINAURAL HEARING AID SYSTEM AND A BINAURAL HEARING AID SYSTEM

(71) Applicant: SIVANTOS PTE. LTD., Singapore (SG)

(72) Inventors: Tobias Daniel Rosenkranz, Erlangen (DE); Tobias Wurzbacher, Fuerth (DE); Christoph Lueken, Langensendelbach (DE); Christos Oreinos, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/873,939

(22) Filed: Jan. 18, 2018

(65) Prior Publication Data

US 2018/0213336 A1 Jul. 26, 2018

(30) Foreign Application Priority Data

Jan. 25, 2017 (DE) ..... 10 2017 201 195

(51) Int. Cl.
*H04R 25/00* (2006.01)

(52) U.S. Cl.
CPC ..... *H04R 25/552* (2013.01); *H04R 25/453* (2013.01); *H04R 25/505* (2013.01)

(58) Field of Classification Search
CPC .... H04R 25/00; H04R 25/353; H04R 25/405; H04R 25/407; H04R 25/453; H04R 25/505; H04R 25/552; H04R 25/554; H04R 3/00; H04R 3/02; H04R 3/04; H04R 1/10; H04R 1/24; H04R 1/26; H04R 1/406; H04S 7/307; H04S 7/308; H04S 3/008
See application file for complete search history.

(56) References Cited

U.S. PATENT DOCUMENTS 8,126,153 B2 2/2012 Fischer
2007/0223753 A1 9/2007 Latzel
(Continued)

FOREIGN PATENT DOCUMENTS

DE 102008015263 A1 10/2009
EP 1841285 A1 10/2007
EP 2988529 A1 2/2016

*Primary Examiner* — Thang V Tran
(74) *Attorney, Agent, or Firm* — Laurence A. Greenberg; Werner H. Stemer; Ralph E. Locher

(57) ABSTRACT

A method operates a binaural hearing aid system with first and second hearing aids. A first audio signal of the first hearing aid is divided into a first high-frequency component and a first low-frequency component. A second audio signal of the second hearing aid is divided into a second high-frequency component and a second low-frequency component. A first provisional division frequency is specified for the division of the first audio signal into the first high-frequency component and the first low-frequency component. A second provisional division frequency is specified for the division of the second audio signal into the second high-frequency component and the second low-frequency component. A division frequency is defined on the basis of the first provisional division frequency and the second provisional division frequency. The first and second audio signals are divided at the division frequency into respective high-frequency components and low-frequency components.

10 Claims, 2 Drawing Sheets

(56) References Cited

U.S. PATENT DOCUMENTS

| | | | | |
|---|---|---|---|---|
| 2010/0290631 | A1* | 11/2010 | Petrausch | H04R 25/353 381/23.1 |
| 2011/0069851 | A1* | 3/2011 | Kjems | H04R 25/407 381/313 |
| 2011/0280424 | A1* | 11/2011 | Takagi | G10L 21/02 381/317 |
| 2012/0250915 | A1* | 10/2012 | Takagi | H04R 25/353 381/312 |
| 2013/0051566 | A1 | 2/2013 | Pontoppidan | |
| 2014/0270222 | A1* | 9/2014 | Hendrix | H04R 1/24 381/71.6 |
| 2016/0007126 | A1* | 1/2016 | Sunohara | H04R 25/453 381/318 |
| 2016/0057548 | A1 | 2/2016 | Wurzbacher et al. | |

* cited by examiner

METHOD FOR OPERATING A BINAURAL HEARING AID SYSTEM AND A BINAURAL HEARING AID SYSTEM

CROSS-REFERENCE TO RELATED APPLICATION

This application claims the benefit, under 35 U.S.C. § 119, of German patent application DE 10 2017 201 195.5, filed Jan. 25, 2017; the prior application is herewith incorporated by reference in its entirety.

BACKGROUND OF THE INVENTION

Field of the Invention

The invention relates to a method for operating a binaural hearing aid system with a first hearing aid and a second hearing aid. A first audio signal of the first hearing aid is divided into a first high-frequency component and a first low-frequency component, and wherein a second audio signal of the second hearing aid is divided into a second high-frequency component and a second low-frequency component.

A sound signal of the environment is typically converted in a hearing aid by an input converter into an electrical signal, and is processed in a signal processing unit according to the audiological requirements of the user and is amplified, in particular in a frequency-dependent manner. The processed signal is then converted by an output converter into an output sound signal which is fed to the ear of the user. For an improved spatial hearing sensation and an improved spatial resolution of the sound signals, binaural hearing aid systems with two hearing aids are often used, one of which the user wears in each case on the left or on the right ear. The hearing aids reciprocally transmit their input signals generated by the respective input converters and/or further audio signals derived therefrom through signal processing and possibly additional control signals and generate the respective output signals for the local output converters from the local signals and the received signals.

In the operation of a hearing aid, an acoustic feedback loop can occur due to an injection of the output sound signal into the input converter, since the output sound signal is thus again subjected to the amplification of the signal processing, which may result in substantial whistling noises or generally interfering noises. The acoustic feedback is therefore usually suppressed by an internal, electrical feedback loop in which a compensation signal, which is fed to the input signal to compensate for the acoustic feedback, is generated using the finished amplified audio signal, for example in an adaptive filter. In order to prevent strongly tonal signal components of the input signal from being extinguished as a result and to prevent the formation of artifacts in the output signal, the amplified audio signal is often frequency-distorted before it is fed to the adaptive filter in order to decorrelate it from the input signal, thus counteracting a formation of artifacts.

Published, European patent application EP 2 988 529 A1 (corresponding to U.S. patent publication No. 2016/0057548) specifies, for example, a method of suppressing acoustic feedback in a hearing aid. A division frequency is defined adaptively depending on the acoustic feedback, and a frequency change is applied only to the signal components above the division frequency. The division frequency is selected here, on the one hand, as high as possible in order to minimize the frequency range in which the signal which has been frequency-modified by the hearing aid, superimposed with the non-frequency-modified direct sound, is audible for a user of the hearing aid, but, on the other hand, at least the frequency of the frequency range which is potentially critical for acoustic feedback should be modified.

An acoustic feedback loop can form in a binaural hearing aid system for each of the two hearing aids. However, for the suppression of the feedback locally in each hearing aid, additional requirements result from the transmission of the individual signals between the two hearing aids and their reciprocal use for the generation of the output signals.

Frequency distortions in binaural hearing aids are known to the person skilled in the art, e.g. in the form of frequency transpositions from U.S. patent publication No. 2013/0051566 A1 in connection with the improvement of the spatial perception of an environment. However, the findings known in this respect are applicable to only a very restricted extent to a suppression of acoustic feedback in binaural hearing aids due to the different objectives.

SUMMARY OF THE INVENTION

The object of the invention is therefore to indicate a method for operating a binaural hearing aid system which is intended to allow the suppression of acoustic feedback with a spatial hearing sensation which is as natural as possible.

The aforementioned object is achieved according to the invention by a method for operating a binaural hearing aid system with a first hearing aid and a second hearing aid. A first audio signal of the first hearing aid is divided into a first high-frequency component and a first low-frequency component, and a second audio signal of the second hearing aid is divided into a second high-frequency component and a second low-frequency component. A first provisional division frequency is specified for the division of the first audio signal into the first high-frequency component and the first low-frequency component. A second provisional division frequency is specified for the division of the second audio signal into the second high-frequency component and the second low-frequency component. A division frequency is defined using the first provisional division frequency and the second provisional division frequency, and the first audio signal is divided at the division frequency into the first high-frequency component and the first low-frequency component for a suppression of acoustic feedback, and the second audio signal is divided at the division frequency into the second high-frequency component and the first low-frequency component.

Advantageous designs, in part inventive per se, form the subject-matter of the subclaims and the following description.

The first audio signal is preferably generated locally in the first hearing aid and the second audio signal locally in the second hearing aid. In particular, the first and the second audio signal can in each case be provided by an intermediate signal in the signal processing operation of the hearing aid concerned.

In one hearing aid, an intermediate signal is usually branched off from the main signal path to suppress acoustic feedback and is fed to a specifically provided feedback suppression device, for example an adaptive filter, where a compensation signal is generated from the intermediate signal and is fed back into the main signal path, so that signal components which are based on the acoustic feedback are extinguished as far as possible in the main signal path. The main signal path contains, in particular, an input signal which is generated by an input converter of the hearing aid from a sound signal of the environment, signal components containing the input signal which are fed to the user-specific signal processing of the hearing aid. The user-specific signal processing entails, in particular, frequency-dependent amplification and noise suppression, a signal correspondingly processed in a user-specific manner and an output signal derived herefrom which is converted by an output converter of the hearing aid into an output sound signal for the user.

The feedback suppression may result here in losses in sound quality, since, on the one hand, a distinction between a feedback-related whistling and a useful signal component in a frequency range relevant to feedback is difficult for particularly tonal and/or stationary useful signals, whereby signal components of the useful signal may also potentially be affected by the extinction by the compensation signal. On the other hand, stationary signal components may furthermore also be audibly modulated by background noises, which may impair the hearing sensation of a hearing situation even if the useful signal is not impaired.

For the above-mentioned reasons, attempts are often made to restrict the feedback suppression only to those frequency ranges in which a feedback is really present or threatens to occur. Depending on the mechanical and electro-acoustic conditions of the hearing aid, these are usually medium to higher frequencies from around 2 kHz, occasionally also from 1 kHz. For this purpose, the compensation signal can be generated in such a way that it contains signal components in the relevant frequency ranges only. This can be achieved by dividing the corresponding intermediate signal branched off from the main signal path accordingly at a division frequency into a high-frequency component and a low-frequency component in the feedback suppression device, and by using only the high-frequency component to generate the compensation signal.

For the suppression of acoustic feedback in a binaural hearing aid system, each local acoustic feedback path, i.e. in each case from the output converter back to the input converter of the same hearing aid, is a priori usually considered separately as a result of the strong attenuation of crosswise feedback. If an acoustic feedback path then changes locally, e.g. due to a changed position of the hearing aid concerned in the ear as a result of jaw movements when the user speaks or the like, the feedback suppression is preferably to be adapted to the changed conditions, which actually also entails a change in the division frequency for a frequency range of the suppression which is optimal in terms of the local hearing sensation.

However, a determination of the respective division frequency which takes place entirely locally, i.e., in particular, only using the locally present acoustic feedback path from the respective output converter back to the input converter of the same hearing aid, can result in further problems in the hearing sensation in the event of an update of the division frequencies. In order to avoid exposing the ear of the user to any unnaturally appearing, abrupt changes, updates of division frequencies are usually carried out with a certain constant "cross-fading", i.e., for example, by a shift of the division frequency toward the new value in a time window which is to be suitably selected. However, if the target values for the respectively updated division frequency are different for the two hearing aids, this can have the surprising result that sound sources are perceived by the user as rotating around him, which results in a clear discrepancy due to the unvarying visual perception of his environment. This perceived localization failure is actually caused by the variable group delay, i.e. the signal transit time over the frequency, as a result of which the interaural time differences can be distorted.

In order to counteract such an erroneously perceived rotation of the sound sources, it is now proposed according to the invention, in a first step, to specify, in each case initially locally, a value for a provisional division frequency and, in a second step, to define the real division frequency at which both the first and also the second audio signal are to be divided into their respective high-frequency and low-frequency components using the two provisional division frequencies of the individual hearing aids. Not only the requirements for the local feedback suppression which result from the two acoustic feedback paths, but also the desire for a spatial hearing perception which is as realistic as possible can thereby advantageously be taken into account.

A first frequency distortion which differs in each case for the first high-frequency component and the first low-frequency component is appropriately applied to the first audio signal and a first frequency-distorted audio signal is generated as a result, and a second frequency distortion which differs in each case for the second high-frequency component and the second low-frequency component is applied to the second audio signal and a second frequency-distorted audio signal is generated therefrom. The first high-frequency and the first low-frequency component of the first audio signal are thus distorted through the application of the first frequency distortion, wherein the distortion takes place to a different extent for the first high-frequency component and the first low-frequency component.

The same applies accordingly to the second frequency distortion in relation to the second high-frequency component and the second low-frequency component. Here, in particular, the first frequency distortion and the second frequency distortion can in each case have an identical effect on the first audio signal and the second audio signal, i.e. the same frequency distortion is applied to the first high-frequency component as to the second high-frequency component, and the same frequency distortion is applied to the first low-frequency component as to the second low-frequency component. In particular, only the respective high-frequency component is frequency-distorted by the first frequency distortion and the second frequency distortion, whereas the respective low-frequency component of the audio signal concerned remains unchanged.

The application of a frequency distortion to signal components from which a compensation signal for suppressing acoustic feedback is to be generated decorrelates the signal components concerned from the corresponding signal components of the main signal path. As a result, the compensation signal generated from the frequency-distorted signal components largely extinguishes the acoustic feedback only, but no further tonal components as a result of the decorrelation. The proposed definition of the division frequency is therefore particularly advantageous for the application of frequency distortions in the suppression of acoustic feedback in a binaural hearing aid system.

The first provisional division frequency is preferably transmitted from the first hearing aid to the second hearing aid, wherein, following the reception of the first provisional division frequency, the second provisional division frequency is transmitted from the second hearing aid to the first hearing aid. The division frequency is defined in the first hearing aid and in the second hearing aid in each case according to the same specified rule on the basis of the first provisional division frequency and the second provisional division frequency. This means that both provisional division frequencies are present locally following the aforementioned transmission procedures in both hearing aids, and the final division frequency at which the two audio signals are in each case to be divided is defined on the basis of a rule which is identical for both hearing aids and is stored in each case in advance in a memory of each of the two hearing aids. In particular, even further communication can take place for this purpose, such as, for example, communication requests to set up a transmission channel for the provisional division frequency, a confirmation of the reception of a provisional division frequency independently from the transmission of the value of the local provisional division frequency and/or synchronization requests for time synchronization, etc. The first provisional division frequency is preferably transmitted to the second hearing aid only after an identified change in the local requirements, particularly in the first acoustic feedback path, thus initiating the synchronization process. The complexity and scope of necessary communication between the two hearing aids for the optimum definition of the division frequency can thus be considerably limited.

The division frequency is favorably defined in each case on the basis of the minimum from the first provisional division frequency and from the second provisional division frequency. In particular, the division frequency is defined here directly as the minimum of the first provisional division frequency and of the second provisional division frequency, or as a minimum within a plurality of specified possible values for the division frequency which, in particular, can form a discrete grid of possible values, so that, e.g. on the basis of the lower of the two provisional division frequencies, the next lowest specified possible value is defined as the division frequency ("floor function"). As a result of the consideration of the minimum of the two provisional division frequencies, the division frequency defined in this way takes account to a sufficient extent of the acoustic conditions in both hearing aids, and is not set too high for one hearing aid. The selection based on a plurality of specified possible values for the division frequency, in particular discrete values, allows even further general conditions to be taken into account.

In one advantageous embodiment of the invention, a first input signal is generated from a sound signal of the environment in the first hearing aid by a first input converter. The first audio signal is generated in the first hearing aid from the first input signal by a first signal processing. In particular, a second input signal is generated from the sound signal in the second hearing aid by a second input converter. The second audio signal is generated in the second hearing aid from the second input signal by a second signal processing. An input signal whose signal components are usually subjected to a user-specific signal processing, such as e.g. a frequency-band-by-frequency-band amplification and noise suppression and possibly dynamic compression, etc., is generated in one hearing aid from a sound signal of the environment using the input converter. The amplification factors in the individual frequency bands are usually specified depending on a hearing weakness of the user which is to be corrected, e.g. using an audiogram. The frequency distortion of the audio signal resulting from the signal processing, and therefore, in a binaural hearing aid system, the proposed definition of the division frequency, are particularly favorable, since a correction of acoustic feedback is thereby advantageously enabled.

A first output signal which is converted by a first output converter of the first hearing aid into a first output sound signal is preferably generated from the first audio signal, wherein acoustic feedback via a first acoustic feedback path from the first output converter to the first input converter is suppressed using the first frequency-distorted audio signal. In particular, the first output signal is generated from the first frequency-distorted audio signal. In particular, a second output signal which is converted by a second output converter of the second hearing aid into a second output sound signal is generated from the second audio signal, preferably from the second frequency-distorted audio signal, wherein acoustic feedback via a second acoustic feedback path from the second output converter to the second input converter is suppressed using the second frequency-distorted audio signal. It is normal practice in hearing aids to use the audio signal resulting from this user-specific signal processing to suppress acoustic feedback. The application of a frequency distortion to this audio signal during the suppression of acoustic feedback is thus also appropriate, and the proposed method for defining the division frequency is therefore particularly advantageous in binaural hearing aid systems.

The division frequency is appropriately updated in response to an external triggering event. Here, a triggering event preferably comprises a change in the sound signal of the environment, a change in the first and/or in the second feedback path, a user input, a change in the first output signal resulting from a user input and a changed classification of the hearing situation by the hearing aid or the binaural hearing aid system. As a result, the division frequency is adapted whenever the external conditions change, i.e. the sound signal of the environment and/or, in particular, the first acoustic feedback path, so that the division frequency is always adapted to the currently prevailing conditions. However, if the external conditions, in particular the first acoustic feedback path, remain stable, no adaptation is necessary, so that no update is performed. Battery power can thereby be saved, since unnecessary update procedures, which would furthermore be associated with transmission power for the transmission procedures, are eliminated.

In a further advantageous embodiment of the invention, the division frequency is updated in response to an internal triggering event. In particular, the internal triggering event can be formed by a periodic sensor value, so that, for example, the division frequency is temporarily set at regular time intervals to a specified, preferably low, value, particularly preferably the lowest possible value, in order to obtain a valid estimated value for the respective feedback path, even in the case of low frequencies. The division frequency is then updated once more using the previously described method.

The invention further describes a binaural hearing aid system with a first hearing aid and a second hearing aid, wherein the binaural hearing aid system is configured to carry out the previously described method. The advantages indicated for the method and for its developments can be transferred accordingly to the binaural hearing aid system.

Other features which are considered as characteristic for the invention are set forth in the appended claims.

Although the invention is illustrated and described herein as embodied in a method for operating a binaural hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1A, 1B:
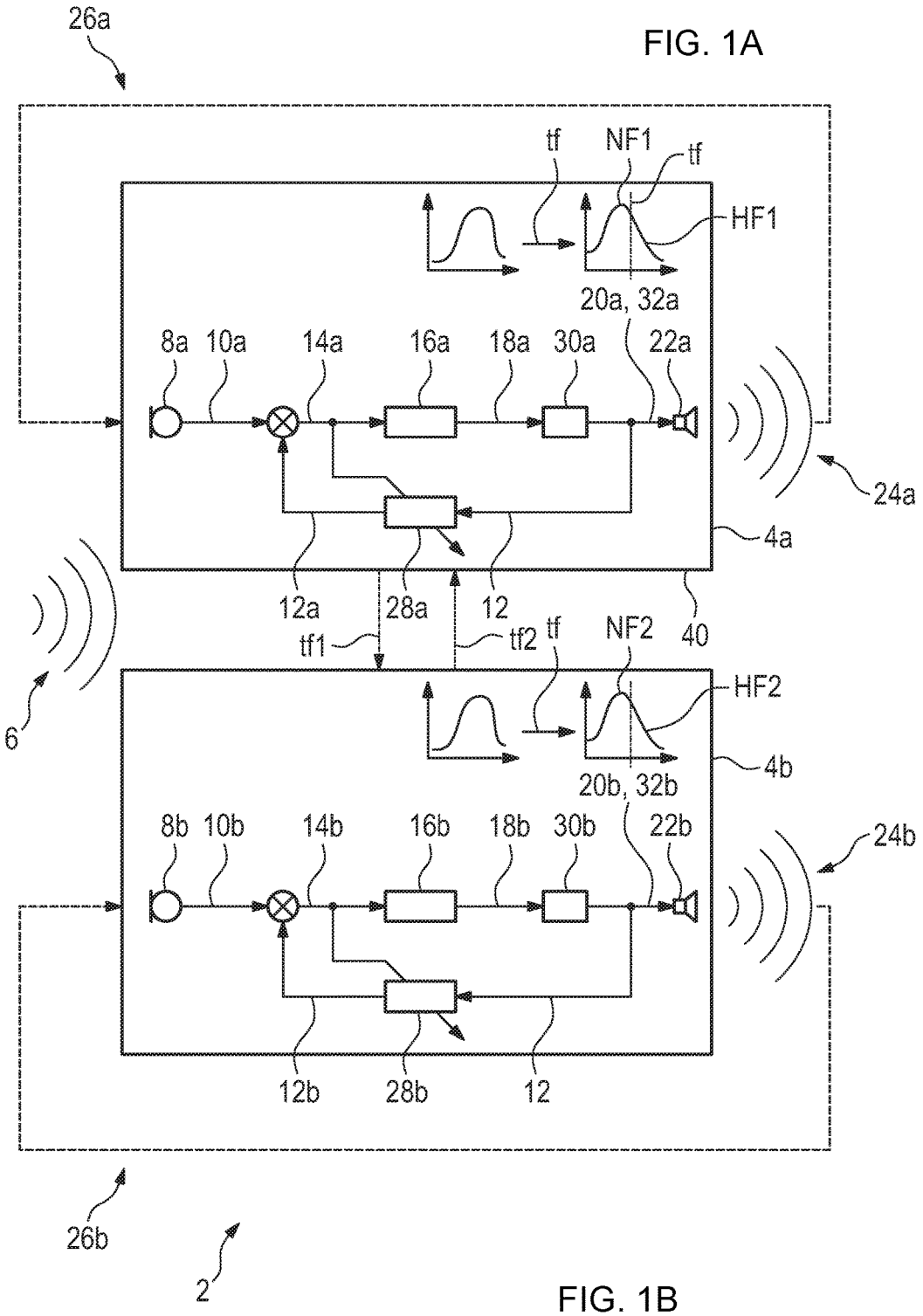
FIGS. 1A-1B are block diagrams of a binaural hearing aid system with two hearing aids and a protocol for synchronizing a division frequency according to the invention.

Referring now to the figures of the drawings in detail and first, particularly to FIGS. 1A-1B thereof, there is shown a binaural hearing aid system 2 in a block diagram. The binaural hearing aid system 2 contains a first hearing aid 4*a* and a second hearing aid 4*b*. A first input signal 10*a* is generated from a sound signal 6 of the environment in the first hearing aid 4*a* by a first input converter 8*a*, and a second input signal 10*b* is generated in the second hearing aid 4*b* by a second input converter 8*b*. The first input converter 8*a* and the second input converter 8*b* are provided here in each case by a microphone. The respective input signal 10*a*, 10*b* is mixed in both hearing aids 4*a*, 4*b* with a first or second compensation signal 12*a*, 12*b* and the first or second compensated signal 14*a*, 14*b* resulting therefrom is fed to a first or second signal processing 16*a*, 16*b* which in each case generates an intermediate signal therefrom which is intended to be designated here as a first or second audio signal 18*a*, 18*b*. A first output signal 20*a* or a second output signal 20*b* is generated from the first or second audio signal 18*a*, 18*b* and is converted by a first output converter 22*a* or a second output converter 22*b* in each case into a first or second output sound signal 24*a*, 24*b*. The first and the second output converter 22*a*, 22*b* are provided here in each case by a loudspeaker. A first acoustic feedback path 26*a* via which acoustic feedback takes place is formed by an injection of the first output sound signal 24*a* into the first input converter 8*a*. The same applies to the second acoustic feedback path 26*b* of the second output sound signal 24*b* to the second input converter 8*b*.

The first or second compensation signal 12*a*, 12*b* is then generated in each case in a first or second adaptive filter 28*a*, 28*b* in order to suppress the acoustic feedback via the first or second acoustic feedback path 26*a*, 26*b*. The first audio signal 18*a* and the second audio signal 18*b* are subjected to a first frequency distortion 30*a* or a second frequency distortion 30*b* in order to decorrelate the respective input variables of the first or the second adaptive filter 28*a*, 28*b* sufficiently from the first or second input signal 10*a*, 10*b*.

Figure 2A:
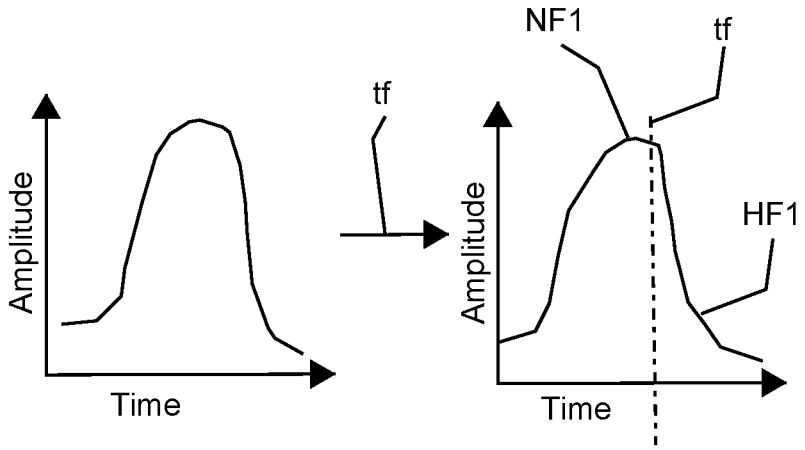
FIG. 2A is a graph showing a division frequency which divides the first audio signal into a first high-frequency component and a low-frequency component.
Figure 2B:
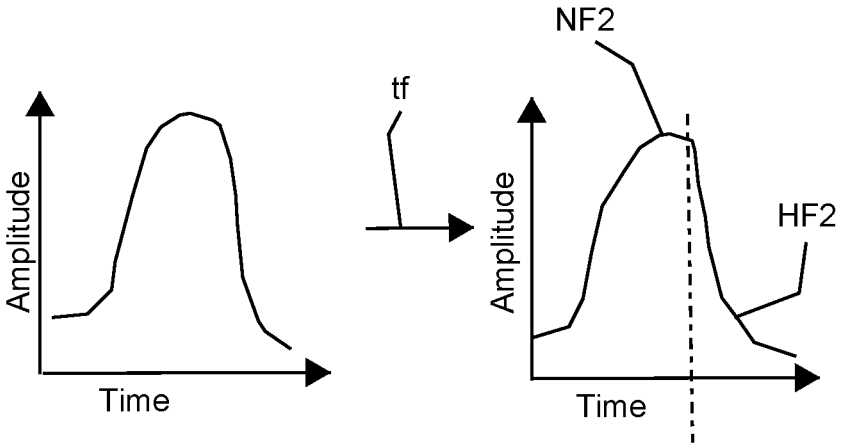
FIG. 2B is a graph showing a division frequency which divides the second audio signal into a second high-frequency component and a second low-frequency component.

The first frequency distortion 30*a*, which is provided in this case by a frequency shift by a constant amount, is applied here to the first audio signal 18*a* only above a division frequency tf which divides the first audio signal 18*a* into a first high-frequency component HF1 and a first low-frequency component NF1 (see FIG. 2A). The resulting first frequency-distorted audio signal 32*a*, which contains the frequency-shifted first high-frequency component HF1 of the first audio signal 18*a*, is then fed on the one hand to the first adaptive filter 28*a* in order to generate the first compensation signal 12*a*, and, on the other hand, is forwarded as a first output signal 20*a* to the first output converter 22*a*. The same applies to the second frequency distortion 30*b* in relation to the division frequency tf and the second high-frequency or second low-frequency component HF2, NF2 resulting therefrom (see FIG. 2B).

In many cases, the respective compensation signal 12*a*, 12*b* is generated only in those frequency bands in which a suppression of the acoustic feedback is actually required. For an improved, artifact-free suppression, the frequency distortion 30*a*, 30*b* is applied for the decorrelation over the entire frequency range in which the feedback is to be suppressed. This means that not only the scope of application of the respective frequency distortion 30*a*, 30*b* is specified here through the definition of the division frequency tf, but also the frequency range of the two compensation signals 12*a*, 12*b* and therefore the scope of application of the suppression of the acoustic feedback.

If a physical change and therefore a change in the transmission function then takes place in one of the two acoustic feedback paths 26*a*, 26*b*, this change has a direct effect on the corresponding correction of the feedback by the respective adaptive filter 28*a*, 28*b*. Division frequencies would now be required in each case in both hearing aids 4*a*, 4*b* for this purpose, wherein the respective optimum division frequency, i.e. with maximum suppression of the acoustic feedback and minimal influencing of the sound impression in the respective output sound signal 24*a*, 24*b*, depends in each case on the local conditions, and therefore two different division frequencies would actually have to be selected, to which cross-fading would then have to be applied in each case locally in the hearing aid 4*a*, 4*b*. However, this cross-fading with different division frequencies can result in a disadvantageous hearing sensation for the user of the binaural hearing aid system 2 in such a way that sound sources surrounding him apparently change their position.

In order to then counteract this hearing impression, in the event of a physical change in the first acoustic feedback path 26*a*, a first provisional division frequency tf1 is first transmitted from the first hearing aid 4*a* to the second hearing aid 4*b*. The second hearing aid 4*b* receives the first provisional division frequency tf1 and, on the basis of the second acoustic feedback path 26*b* which, in some instances, could also have changed slightly, in turn determines a second provisional division frequency tf2 which is transmitted to the first hearing aid 4*a*. If no change has taken place in the second acoustic feedback path 26*b* since the last update of the division frequency tf, the current division frequency tf can also be transmitted as the value of the second provisional division frequency tf2.

Both hearing aids 4*a*, 4*b* are now provided in each case with the first and the second provisional division frequency tf1, tf2. In order to achieve a uniform hearing sensation and nevertheless ensure an adequate suppression of the feedback on both hearing aids 4*a*, 4*b*, the minimum from the first provisional division frequency tf1 and the second provisional division frequency tf2 is now specified as the division frequency tf. The first audio signal 18*a* is then divided at the division frequency tf as described into a first high-frequency component HF1 and a first low-frequency component NF1, wherein the first high-frequency component HF1 is frequency-shifted and fed as the first frequency-distorted audio signal 32*a* to the first adaptive filter 28*a* for the generation of the first compensation signal 12*a*. The same applies to the second audio signal 18*b* and the second frequency-distorted audio signal 32*b* in relation to the same division frequency tf.

Although the invention has been illustrated and described in detail by means of the preferred example embodiment, the invention is not restricted by this example embodiment. Other variations can be derived herefrom by the person skilled in the art without departing the protective scope of the invention.

The following is a summary list of reference numerals and the corresponding structure used in the above description of the invention:

2 Binaural hearing aid system
4*a*, 4*b* First/second hearing aid
6 Sound signal of the environment
8*a*, 8*b* First/second input converter
10*a*, 10*b* First/second input signal
12*a*, 12*b* First/second compensation signal
14*a*, 14*b* First/second compensated signal
16*a*, 16*b* First/second signal processing
18*a*, 18*b* First/second audio signal
20*a*, 20*b* First/second output signal
22*a*, 22*b* First/second output converter
24*a*, 24*b* First/second output sound signal
26*a*, 26*b* First/second acoustic feedback path
28*a*, 28*b* First/second adaptive filter
30*a*, 30*b* First/second frequency distortion
32*a*, 32*b* First/second frequency-distorted audio signal
HF1, HF2 First/second high-frequency component
NF1, NF2 First/second low-frequency component
tf Division frequency
tf1, tf2 First/second provisional division frequency

The invention claimed is:

1. A method for operating a binaural hearing aid system having a first hearing aid and a second hearing aid, which comprises the steps of:

dividing a first audio signal of the first hearing aid into a first high-frequency component and a first low-frequency component, wherein a first provisional division frequency is specified for dividing the first audio signal into the first high-frequency component and the first low-frequency component;

dividing a second audio signal of the second hearing aid into a second high-frequency component and a second low-frequency component, wherein a second provisional division frequency is specified for dividing the second audio signal into the second high-frequency component and the second low-frequency component;

defining a division frequency on a basis of the first provisional division frequency and the second provisional division frequency;

dividing the first audio signal at the division frequency into the first high-frequency component and the first low-frequency component for a suppression of a first acoustic feedback; and dividing the second audio signal at the division frequency into the second high-frequency component and the second low-frequency component for a suppression of a second acoustic feedback.

2. The method according to claim 1, which further comprises:

applying a first frequency distortion which differs in each case for the first high-frequency component and the first low-frequency component to the first audio signal and a first frequency-distorted audio signal is generated as a result; and applying a second frequency distortion which differs in each case for the second high-frequency component and the second low-frequency component to the second audio signal and a second frequency-distorted audio signal is generated therefrom.

3. The method according to claim 1, which further comprises:

transmitting the first provisional division frequency from the first hearing aid to the second hearing aid;

transmitting the second provisional division frequency from the second hearing aid to the first hearing aid following a reception of the first provisional division frequency; and defining the division frequency in the first hearing aid and in the second hearing aid in each case according to a same specified rule on a basis of the first provisional division frequency and the second provisional division frequency.

4. The method according to claim 3, wherein the division frequency is defined in each case on a basis of a minimum from the first provisional division frequency and the second provisional division frequency.

5. The method according to claim 1, which further comprises:

generating a first input signal from a sound signal of an environment in the first hearing aid by a first input converter; and generating the first audio signal in the first hearing aid from the first input signal by a first signal processing.

6. The method according to claim 5, which further comprises:

generating a first output signal which is converted by a first output converter of the first hearing aid into a first output sound signal from the first audio signal; and suppressing the first acoustic feedback via a first acoustic feedback path from the first output converter to the first input converter using a first frequency-distorted audio signal.

7. The method according to claim 6, wherein the division frequency is appropriately updated in response to an external triggering event.

8. The method according to claim 7, wherein the external triggering event contains a change in the sound signal of the environment, a change in the first acoustic feedback path and/or in a second acoustic feedback path, a user input, a change in the first output sound signal resulting from the user input and a changed classification of a hearing situation by one of the first and second hearing aids or the binaural hearing aid system.

9. The method according to claim 6, which further comprises updating the division frequency in response to an internal triggering event.

10. A binaural hearing aid system, comprising:

a first hearing aid;

a second hearing aid; and the binaural hearing aid system programmed to:

divide a first audio signal of said first hearing aid into a first high-frequency component and a first low-frequency component, wherein a first provisional division frequency is specified for dividing the first audio signal into the first high-frequency component and the first low-frequency component;

divide a second audio signal of said second hearing aid into a second high-frequency component and a second low-frequency component, wherein a second provisional division frequency is specified for dividing the second audio signal into the second high-frequency component and the second low-frequency component;

define a division frequency on a basis of the first provisional division frequency and the second provisional division frequency;

divide the first audio signal at the division frequency into the first high-frequency component and the first low-frequency component for a suppression of a first acoustic feedback; and divide the second audio signal at the division frequency into the second high-frequency component and the second low-frequency component for a suppression of a second acoustic feedback.

* * * * *